United States Patent [19]

Asari et al.

[11] 4,424,696

[45] Jan. 10, 1984

[54] INDIRECT EXTRUSION PRESS

[75] Inventors: Akira Asari, Osaka; Tatsuhiko Noyori; Masakazu Ueda, both of Kobe; Takahiko Ishii, Nishinomiya, all of Japan

[73] Assignee: Kabushiki Kaisha Kobe Seiko Sho, Kobe, Japan

[21] Appl. No.: 267,387

[22] Filed: May 26, 1981

[30] Foreign Application Priority Data

May 24, 1980 [JP] Japan ..... 55-70444
May 26, 1980 [JP] Japan ..... 55-70506

[51] Int. Cl.[3] ..... B21C 27/00; B21C 35/06
[52] U.S. Cl. ..... 72/273.5; 72/272
[58] Field of Search ..... 72/265, 273.5, 253.1, 72/255, 272

[56] References Cited

U.S. PATENT DOCUMENTS

| | | | |
|---|---|---|---|
| 3,530,702 | 9/1970 | De Ridder | 72/273.5 |
| 4,103,529 | 8/1978 | Huertgen et al. | 72/273.5 |
| 4,230,661 | 10/1980 | Asari et al. | 264/323 |
| 4,251,202 | 2/1981 | Asari et al. | 425/461 |
| 4,345,450 | 8/1982 | Doudet | 72/273.5 |

FOREIGN PATENT DOCUMENTS

| | | | |
|---|---|---|---|
| 52-752 | 1/1977 | Japan | 72/273.5 |
| 2005172 | 4/1979 | United Kingdom | 72/273.5 |

*Primary Examiner*—Lowell A. Larson

*Attorney, Agent, or Firm*—Oblon, Fisher, Spivak, McClelland & Maier

[57] ABSTRACT

An indirect extrusion press including a press frame body of the Rahmen structure. The press frame body is formed of a press platen and a main cylinder frame, which are rigidly connected together. Movably disposed between the press platen and main cylinder frame is a container adapted to retain a billet therein. A die stem fixedly extends toward the container from the platen while a pressing stem slidably extends toward the container from the main cylinder frame. Hydraulic cylinders are provided with the platen to shift the container back and forth along the longitudinal center line of the press. Hydraulic coupling cylinders are also provided with a crosshead from which the pressing stem extends and the pistons of both cylinders are connected to their respective container holders. The relative position of the container and pressing stem is maintained constant during an extrusion stroke so that the container-shifting force is added to an extrusion force. An effective scalping operation of the container is performed by using not only the container-shifting cylinders but also the coupling cylinders. An intermediate frame may also be slidably provided on the die stem such that the shifting force for the intermediate frame may also be added to the extrusion force or scalping force. The extra extrusion force is received by the container and its related moving members, thereby enabling use of the press frame body without reinforcement and allowing a reduction in the total number of parts and weight necessary, and simplification of the press.

7 Claims, 7 Drawing Figures

INDIRECT EXTRUSION PRESS

BACKGROUND OF THE INVENTION

1. Field of the Invention

This invention relates to an indirect extrusion press, and more particularly, to an improved indirect extrusion press equipped with a hydraulic coupling device and capable of adding the container-shifting force to the extrusion force.

2. Description of the Prior Art

In a conventional indirect extrusion press illustrated in FIG. 1, a press platen 51 defining a through bore 51A and a main cylinder frame 52 are spacedly and oppositely disposed along the longitudinal center line of the press in the front and back positions respectively, and are rigidly connected together by means of tie rods 53 arranged in "X" patterns so as to form the press frame body into a Rahmen structure.

A main ram 55 is slidably received in a main cylinder 54 fixedly secured on the main cylinder frame 52. An extrusion force generating unit is constituted by the main ram 55, crosshead 56, pressing stem 71, etc. Crosshead 56 and main ram 55 are arranged in such a manner that they may be shifted forward namely, toward press platen 51) under no load by means of side cylinder devices, each of which devices includes a side cylinder 57 and piston 58. On the other hand, a die stem 74 of a cylindrical configuration is fixed on the press platen 51 along the longitudinal center line of the press, to which die stem 74 is mounted a die 73 via a die holder 72.

A container 70 can be freely shifted back and forth along the longitudinal center line of the press, namely, along the pressing direction by means of container-shifting cylinder devices, each of which is formed of a cylinder 61 and piston 62. The relative position of container 70 and pressing stem 71 can be fixed by means of hydraulic coupling devices, each of which is formed of a cylinder 59 and piston 60. Therefore, each of container-shifting cylinders 61 is attached to main cylinder frame 52 while each of hydraulic coupling cylinders 59 is secured to crosshead 56 and is slidably fitted through main cylinder frame 52. Furthermore, the pistons 60, 62, which are slidably received in their respective cylinders 59, 61, are coupled at their rearmost ends with a rear frame 76 provided integrally with the main cylinder 54 on the periphery of the latter. The rear frame 76 can axially be movable independently from main cylinder 54 insofar as a large ring-like bore is provided in the center of rear frame 76. Rear frame 76 and container holders 69 are mutually connected by means of tie rods 77.

In addition the above-described members or devices, numeral 63 indicates an intermediate frame which is freely shiftable by means of a hydraulic cylinder device including a cylinder 64 and piston 65. Intermediate frame 63 is fitted over die stem 74 through a guide block 75, etc. Intermediate frame 63 is equipped with a vertical shear device which includes a hydraulic cylinder 66 and piston 67. A shearing edge 68 is adapted to sever off a discard from an extruded article.

In the conventional indirect extrusion press shown in FIG. 1, a billet loaded in container 70 may be indirectly extruded through die 73 by shifting container 70 in such a manner that the container slides over die stem 74 while fixing the relative position of container 70 and pressing stem 71. Although the above-noted conventional press is constructed in such a manner that the container-shifting force may be added to the extrusion force of main cylinder 54 during each extrusion stroke, it is accompanied by following drawbacks.

Namely, the overall pressing force to be generated during an extrusion stroke is a combination of forces exerted on main cylinder 54 and side cylinders 57 as well as a force applied onto the container unit. In order to make the press capable of withstanding the overall pressing force, it is indispensable to make each constituent parts of the main structure, which is formed by pressing platen 51, main cylinder frame 52 and tie rods 53 connecting said platen 51 and frame 52 together into the Rahmen structure, more durable by a degree at least equivalent to the shifting force of the container unit. This certainly results in an increase in its number of constituent parts a complication of its structure and an increase in its weight.

The inventors of this invention have heretofore made a number of inventions, including, for example, copending U.S. patent application Ser. No. 199,626 filed Oct. 22, 1980, U.S. Pat. Nos. 4,251,202 and 4,230,661 and copending U.S. patent application Ser. No. 946,330 filed Sept. 27, 1978, all of which relate to an extrusion press or extrusion process.

SUMMARY OF THE INVENTION

An object of this invention is to solve the drawbacks of the above-described prior art press.

Another object of this invention is to provide an indirect extrusion press of a Rahmen structure and with extremely high movement accuracy.

A still further object of this invention is to provide an indirect extrusion press capable of increasing its effective extrusion force by adding the container-shifting force to the extrusion force.

An additional object of this invention is to provide an indirect extrusion press which contemplates simplification of the structure and mechanism, and reduction in both total number of parts and overall press weight.

A still further object of this invention is to provide an indirect extrusion press which permits effective container scraping work.

In order to achieve the above objects, the present invention provides in one aspect in indirect extrusion press in which a press platen and main cylinder frame are disposed oppositely, i.e., in the front and back positions, respectively, and connected together by means of a plurality of tie rods into a press frame body of a Rahmen structure a die stem is fixed on the press platen along the longitudinal center line of the press, and a container and pressing stem are shifted so that a billet loaded in the container can be indirectly extruded through a die attached to a die stem, the press characterized by the fact that the platen is provided with a plurality of hydraulic cylinders adapted to shift the container, a crosshead is provided with a plurality of hydraulic coupling cylinders, the pistons of the container shifting cylinders and coupling cylinders are coupled with container holders so that a container unit is formed, the relative position of the container and pressing stem is fixed during each extrusion stroke, and the container-shifting force is added to the extrusion force via the pressing stem.

BRIEF DESCRIPTION OF THE DRAWINGS

Various other objects, features and attendant advantages of the present invention will be more fully appreciated as the same becomes better understood from the following detailed description when considered in connection with the accompanying drawings in which like reference characteristics designate like or corresponding parts throughout the several views and wherein.

DETAILED DESCRIPTION OF THE PREFERRED EMBODIMENT

Referring first to FIGS. 2 through 6, a preferred embodiment of the present invention will be described hereinbelow in detail. While the embodiment is a single-acting indirect extrusion press equipped with an intermediate frame, this invention may also be applied to any indirect extrusion presses other than those equipped with such intermediate frame. It may equally be applied to double-acting indirect extrusion presses.

Figure 1:
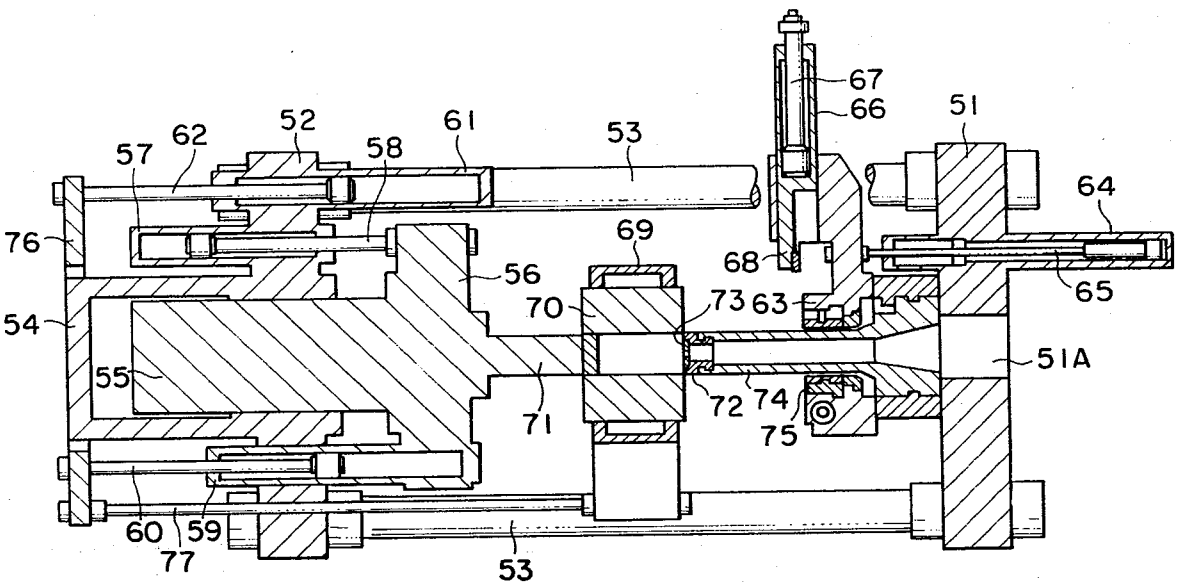
FIG. 1 PRIOR ART
FIG. 1 is a cross-sectional side elevational view of an example of conventional indirect extrusion presses.
Figure 2:
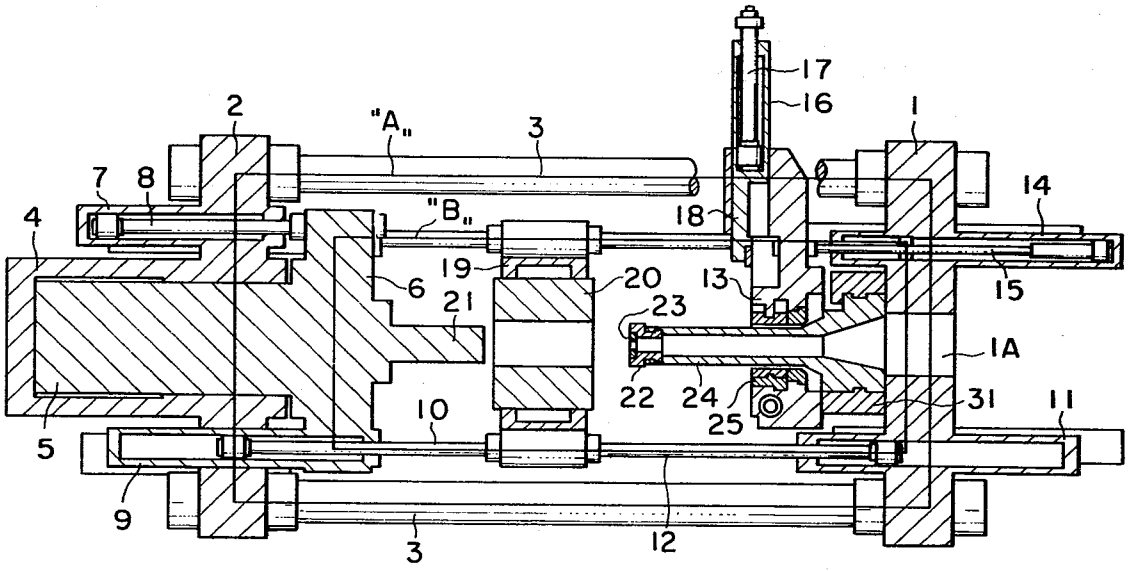
FIG. 2 is a cross-sectional side elevational view of an indirect extrusion press according to one embodiment of the present invention, in which all movable parts, members, units, and the like are in their initial positions.

In FIG. 2 where the single-acting indirect extrusion press equipped with an intermediate frame is in its initial position, a press platen 1 defining a through bore 1A along the longitudinal center line of the press and a main cylinder frame 2 are spaced apart and oppositely disposed in front and back positions, respectively. Platen 1 and frame 2 are firmly connected to each other by means of tie rods 3 which extend in "X" patterns along each of the top, bottom, and both sides of the press, thereby forming a press frame body of a Rahmen structure as indicated by the letter "A" in FIG. 2.

A main cylinder 4 is fixed on main cylinder frame 2 along the longitudinal center line of the press, and slidably receives a main ram 5 to form an extrusion force generating unit. Main ram 5 is provided through a crosshead 6 with a pressing stem 21, which extends forward along the center line of the press (here, the term "forward" means the pressing direction while its opposite direction is expressed by the term "backward").

Main cylinder frame 2 is equipped with side cylinders 7. A piston 8, which is slidably fitted in each side cylinder 7, is coupled with crosshead 6 so as to enable pressing stem 21 to move forward without any load.

On the back end face of press platen 1, is provided a die stem supporting device 31 through which the front end, i.e., base portion of die stem 24 is fixedly secured along the center line of the press. Needless to say, die stem 24 is detachable and may be taken out of the press if necessary.

Die stem 24 is of an elongated cylindrical body. Die 23 is attached at the rear extremity thereof via a die holder 22.

A container 20 has a billet 27 received along the center line of the press and is held in place by means of container holders 19 which in turn are coupled in a cooperative manner with container shifting devices and hydraulic coupling devices, thus constituting a container unit as indicated by the letter "B" in FIG. 2. Thus, in the interior of the press frame body A, four container-shifting cylinders 11 are disposed and fixed on press platen 1 at the diagonally-opposed four corners of platen 1. Pistons 12, which are slidably received in their respective cylinders 11, are connected to container holders 19, respectively. On the other hand, hydraulic coupling cylinders 9 are fixedly secured with crosshead 6 in a diagonal arrangement. The corresponding pistons 10 are coupled with corresponding container holders 19.

An intermediate frame 13 is fitted over die stem 24 via a guide ring 25 and etc. and is movable back and forth along the longitudinal direction of die stem 24 by means of pistons 15 slidably received in their respective cylinders 14 which are secured to press platen 1. Intermediate frame 13 includes a vertical shearing device including a cylinder 16, piston 17, shear 18, etc. Movable members such as crosshead 6 and container holders 19 are slidingly guided by means of guide members (not shown).

Figure 3:
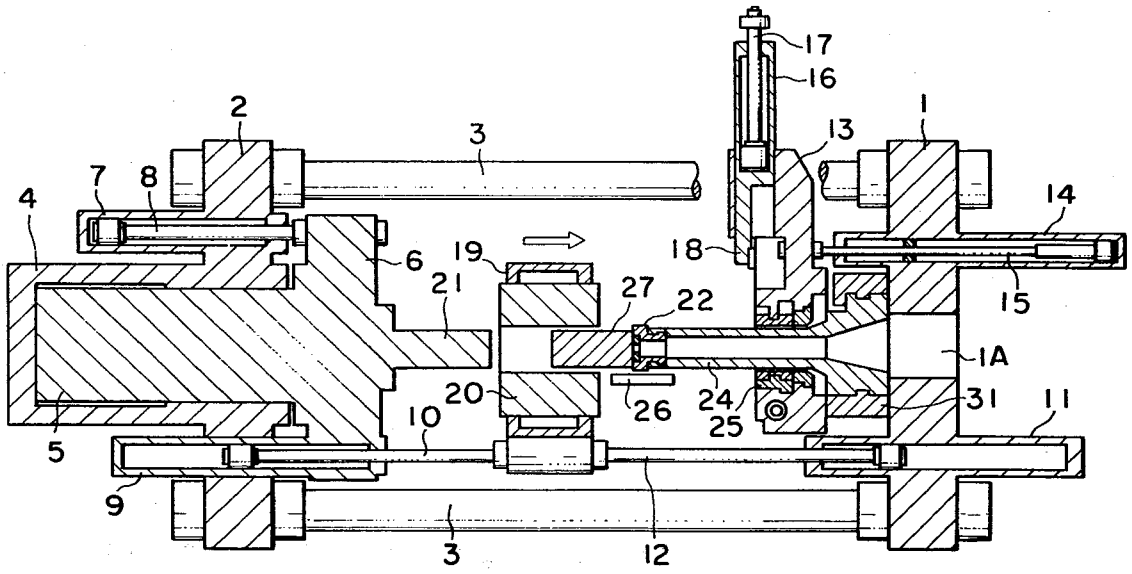
FIG. 3 is a cross-sectional side elevational view of the indirect extrusion press of FIG. 2, which press is in the billet-loading stroke position.

An extrusion operation is now described referring to FIGS. 3 to 6 wherein FIG. 3 illustrates a billet 27 being charged into the receiving hole of container 20 by means of a billet loader 26 while shifting container 20 forward. In other words, extrusion operation may be started after charging billet 27 into container 20 by a suitable mechanism.

Subsequent to placing billet 27 in container 20, billet loader 26 is swung out of the press. Then, working oil is supplied to the rear chamber of each side cylinder 7 to shift main ram 5 forward under no load, thereby holding billet 27 between the front face of pressing stem 21 and die 23 with a dummy block or pressing disc 29 interposed between the front face and billet 27, now ready for extrusion.

Then, working oil is fed to the rear chamber of each side cylinder 7 as well as to main cylinder 4 so that main ram 5 resumes its advance. This upsets billet 27 into container 20, thereby filling up container 20 with billet 27 and generating a friction force between container 20 and billet 27. Thereafter, working oil is supplied to the rear chamber of each container-shifting cylinder 11, the back chamber of each side cylinder 7 and main cylinder 4, resulting in a simultaneous advance of container 20 and pressing stem 21. Thus, billet 27 is extruded through die 23 provided with die stem 24 while maintaining a state in which any relative movement of container 20 is restrained with respect to main ram 5.

Here, by adjusting the delivery rate of each pump so as to make the moving speed of the piston of each container-shifting cylinder 11 equal to or faster than that of main ram 5, the shifting force of container 20 can be combined with the extrusion force through billet 27 because the oil within the hydraulic coupling 9 is entrapped. Furthermore, container 20 can be synchronized in motion with stem 21 by virtue of the friction force between billet 27 and container so long as the friction force is larger than the container shifting force 20.

Figure 4:
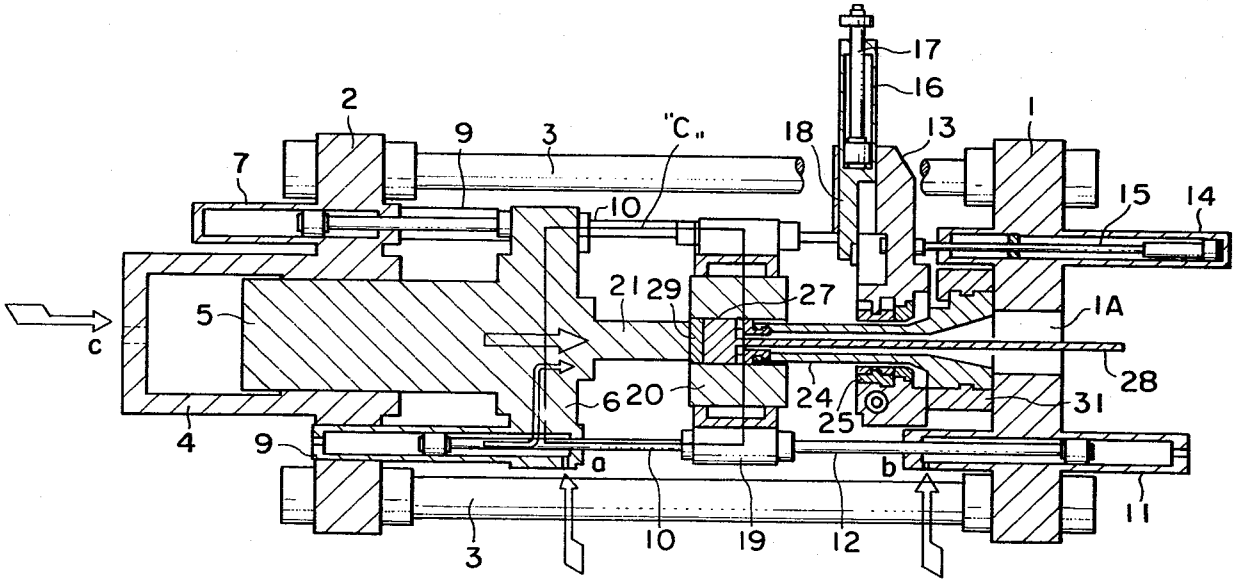
FIG. 4 is a cross-sectional side elevational view of the indirect extrusion press of FIG. 2, which press is in the extrusion stroke position.

On the other hand, where working oil is supplied to the forward portion of each hydraulic coupling cylinder 9, the container-shifting force is added to the main ram-shifting force, i.e., extrusion force via pressing stem 21 since cylinder 9 is secured to crosshead 6 and its piston 10 is coupled with its respective container holder 19. In FIG. 4, working oil is charged into each of ports a, b and c.

Here, the pressure increment timing of each hydraulic coupling cylinder 9 becomes important for intercoupling main ram 5 and container 20 at a desired position in accordance with the length of billet 27 by making use of friction force between the container 20 and billet 27.

The above pressure increment timing may be at any time after the friction force between container 20 and billet 27 becomes, subsequent to the upsetting step of the billet, greater than the pressing force of each of coupling cylinders 9 and container-shifting cylinders 11 but immediately before the friction force becomes smaller than the pressing force due to a decrease in length of billet 27. After supplying working oil to each coupling cylinder 9 and locking the relative position of container 20 and die stem 24 (or crosshead 6), the container-shifting force is added to the extrusion force during the entire extrusion stroke through hydraulic coupling cylinders 9, while maintaining the relative position of container 20 and die stem 24 (or crosshead 6). The relative position of container 20 and crosshead 6 is fixed as long as they are coupled under pressure, thereby forming the Rahmen structure "C" as shown in FIG. 4 and further improving the accuracy of movement.

In the above-noted extrusion stroke, the extrusion force generated by main cylinder 4 and side cylinders 7 is added with the container-shifting force. The above extrusion force is received by the Rahmen structure of press frame body A while the extrusion force of container-shifting cylinders 11 is received by the container unit B. Accordingly, an article 28 can be extrusion-formed by the combined greater pressing force without need for reinforcing press frame body A.

Figure 5:
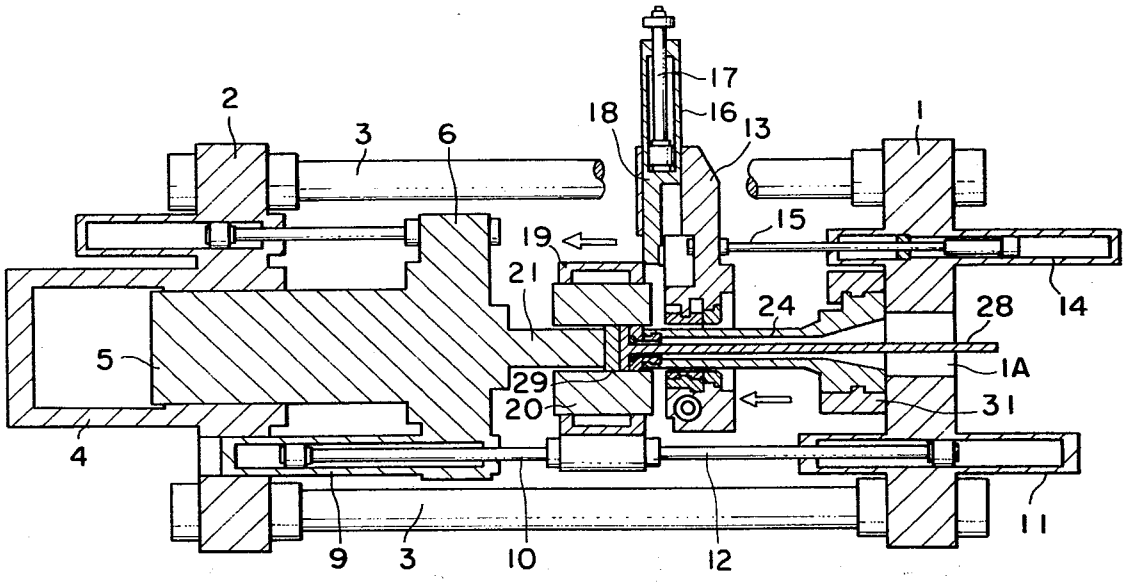
FIG. 5 is a cross-sectional side elevational view of the indirect extrusion press of FIG. 2, which press is in the container-scraping stroke position.
Figure 6:
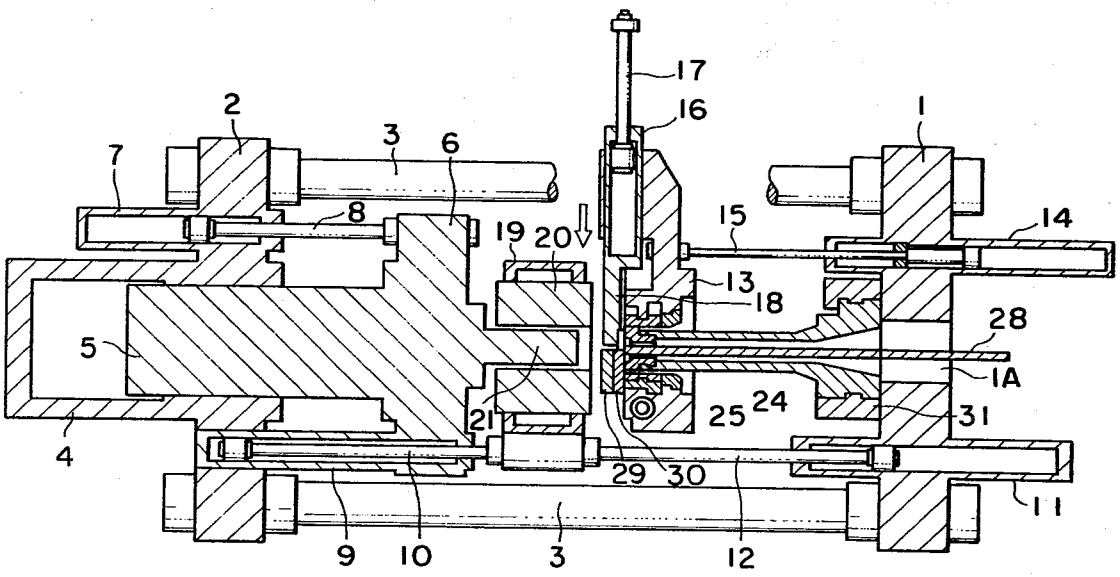
FIG. 6 is a cross-sectional side elevational view of the indirect extrusion press of FIG. 2, which press is in the discard-severing stroke position.

After completion of the extrusion stroke, the receiving hole of container 20 is subjected to scraping or cleaning as shown in FIG. 5 when container 20 is retracted backward. Then, as shown in FIG. 6, a discard 30 and extruded article 28 are severed off by means of a suitable shearing device and each movable member is returned to its original position, resulting in completion of the pressing cycle.

Figure 7:
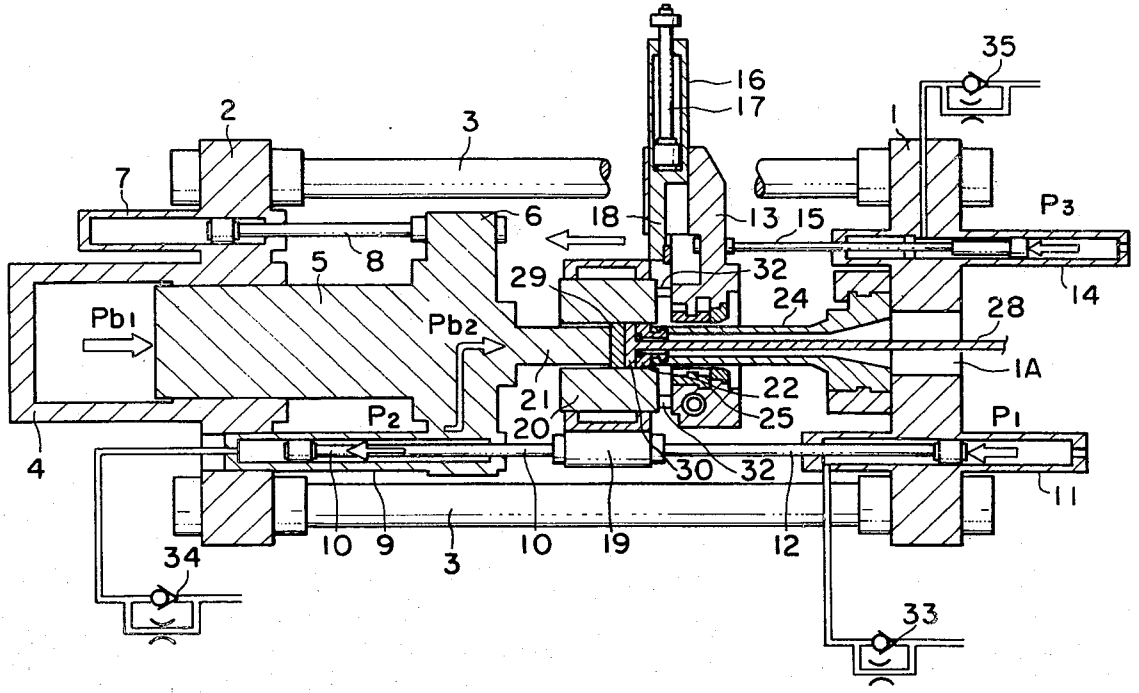
FIG. 7 is a cross-sectional side elevation of the indirect extrusion of FIG. 2, illustrating in further detail the container-scraping stroke.

The container-scraping stroke is now described in further detail referring to FIG. 7. Upon the completion of the extrusion stroke, the piston rod 12 of each container-shifting cylinder 11 is extended backward to shift container 20 in the direction shown by an arrow. During this backward movement of container 20, the inner wall of the through bore of container 20 is cleaned up, in other words, scraped together with discard 30 by the dummy block or pressing disc 29 which has very little clearance with the inner wall. Here, the load occurring for removal of the resultant shell from the inner wall of the container 20 is not constant during the scraping stroke but tends to change considerably. To avoid the so-called stick-slip phenomenon, a brake circuit 33 is provided.

As described above, the force required for the scraping work of container 20 varies considerably depending on the thickness of discard 30, the material of the billet, the diameter of the through bore of container 20, the temperature of billet 27, etc. In some instances, the shifting force $P_1$ of each of container-shifting cylinders 11, 12 becomes insufficient to perform the scraping operation. If this occurs, working oil is supplied to hydraulic coupling cylinders 9 in such a fashion that the pistons of these cylinders are retracted. In the illustrated embodiment, an additional pulling forces $P_2$ is applied to container 20 by each of hydraulic coupling cylinders 9 to shift container 20 toward the main ram 5.

If addition of the pulling forces by hydraulic coupling cylinders 9 is proven to still be insufficient to conduct scraping operation and the press is provided with an intermediate frame, piston 15 of each cylinder 14 may be extended backward and, in the illustrated embodiment, a force $P_3$ combined with the container-shifting power via spacer blocks 32. Here, the combined force $P_1+P_3$ is backed up by the pressure $Pb_1$ of the working oil in main cylinder 4 while the force $P_2$ is backed up by the reaction force $Pb_2$ occurred at crosshead 6. Brake circuits 33, 34, 35 are each adapted to avoid so-called stick-slip phenomenon. In the illustrated embodiment, brake circuits 33, 34, 35 are provided separately with their respective cylinders 9, 11, 15. However, more than one cylinder may be connected to a common brake circuit.

As described above, pressing platen 1 and main cylinder frame 2 are spacedly and oppositely arranged in the front and back positions and connected together by means of a plurality of tie rods 3 into a press frame body A of the Rahmen structure. Die stem 24 is fixedly disposed on pressing platen 1 along the center line of the press. Container 20 loaded with the billet 27 and pressing stem 21 are shifted so as to indirectly extrude the billet 27 through the die 23 attached to die stem 24. According to this invention, platen 1 is provided with a plurality of hydraulic cylinders 11 for shifting container 20 while a plurality of hydraulic coupling cylinders 9 are secured with crosshead 6. Piston 12, 10 of container-shifting cylinders 11 and coupling cylinders 9 are coupled with container holders 19, thus constituting container unit B. The relative position of container 20 and pressing stem 21 is fixed during an extrusion stroke so that the container shifting force is added to the extrusion force via pressing stem 21. This arrangement can bring about the following advantages:

The connection between container 20 and pressing stem 21 or container holders 19 and crosshead 6 can be performed at a desired relative position in accordance with the length of billet 27. The container-shifting force can be added to the extrusion force, resulting in an increase of the effective extrusion force. In addition, a Rahmen structure is formed by crosshead 6 and container holders 19 as shown in FIG. 4 while the crosshead 6 and container holders 19 are coupled together. The container-shifting cylinders 11, hydraulic coupling cylinders 9 and container 20 are arranged in a cooperative manner to constitute the container unit B to enhance the movement accuracy which is most important for indirect extrusion. Therefore, the main structure, namely, press frame body A may be formed without need for taking the force of container-shifting cylinders 11 into consideration, resulting in such advantages that the structure and mechanism of the press can be simplified, the total numbers of parts may be reduced and the press may be reduced in weight.

Obviously, many modifications and variations of the present invention are possible in light of the above teaching. It is therefore to be understood that within the scope of the appended claims the invention may be practiced otherwise than as specifically described herein.

What is claimed is:

1. An indirect extrusion press comprising:

a press frame body of a Rahmen structure which comprises a press platen and a main cylinder frame spacedly and oppositely disposed in the front and back positions, respectively;

a plurality of tie rods interconnecting said press platen and said main cylinder frame;

a die stem fixedly secured on said press platen along the longitudinal center line of the press and which comprises a die at one end thereof opposite said press platen;

a container adapted to retain a billet therein;

a main ram slidably movable relative to said main cylinder frame and which further comprises a crosshead at the front end thereof and a pressing stem extending toward said container from said crosshead, said container and pressing stem being movable so as to indirectly extrude said billet through said die;

a plurality of container holders;

a plurality of hydraulic cylinders for shifting said container and which are mounted on said platen; and a plurality of hydraulic coupling cylinders secured to the crosshead, each of said container-shifting cylinders and coupling cylinders further comprising pistons slidably mounted therein and respectively interconnecting said container holders with said crosshead and said platen to thereby form a container unit, the relative position of said container and said pressing stem being fixed by said coupling cylinders during an extrusion stroke so that the container-shifting force is added to an extrusion force.

2. The indirect extrusion press according to claim 1, further comprising a pressing disc operatively associated with said container and means for shifting said container toward said main ram while backing up and main ram such that a coupling force of each of said hydraulic coupling cylinders is added to the container-shifting force upon cleaning of said container by said pressing disc.

3. The indirect extrusion press according to claim 1 or 2, wherein said press further comprises an intermediate frame slidably disposed on said die stem and a plurality of hydraulic cylinders fixedly secured on said press platen for shifting said intermediate frame along the die stem and wherein a coupling force of each of said hydraulic coupling cylinders and the shifting force of each of the hydraulic cylinders are added to the shifting force of the container upon scraping operation in said container by shifting said container toward said main ram while backing up said main ram.

4. The indirect extrusion press according to claim 3, wherein said intermediate frame further comprises a vertical shearing device for severing a discard portion of said billet from an article extruded from said billet.

5. The indirect extrusion press according to claim 1, wherein said press further comprises at least one hydraulic brake circuit in communication with said hydraulic cylinder for avoiding stick-slipping of said container.

6. The indirect extrusion press according to claim 2, wherein said press further comprises at least one hydraulic brake circuit in communication with said hydraulic coupling cylinders and/or hydraulic cylinders for avoiding stick-up of said container.

7. The indirect extrusion press according to claim 3, wherein said press further comprises at least one hydraulic brake circuit in communication with said hydraulic cylinders, hydraulic coupling cylinders, and/or hydraulic cylinders for avoiding stick-slip of said container.

* * * * *